US008672443B2

(12) United States Patent
Hazeyama

(10) Patent No.: US 8,672,443 B2
(45) Date of Patent: Mar. 18, 2014

(54) LIQUID EJECTION APPARATUS AND STORAGE MEDIUM STORING PROGRAM

(75) Inventor: Tomoaki Hazeyama, Yokkaichi (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 333 days.

(21) Appl. No.: 13/250,014

(22) Filed: Sep. 30, 2011

(65) Prior Publication Data

US 2012/0154474 A1 Jun. 21, 2012

(30) Foreign Application Priority Data

Dec. 20, 2010 (JP) ..... 2010-283393

(51) Int. Cl.
*B41J 2/165* (2006.01)

(52) U.S. Cl.
USPC ..... 347/22; 347/23; 347/29

(58) Field of Classification Search
USPC ..... 347/22, 23, 29, 35
See application file for complete search history.

(56) References Cited

U.S. PATENT DOCUMENTS

| | | | | |
|---|---|---|---|---|
| 6,293,648 | B1 | 9/2001 | Anderson | |
| 2007/0285456 | A1 | 12/2007 | Takasu et al. | |
| 2009/0033707 | A1* | 2/2009 | Shimazaki | 347/29 |
| 2009/0109257 | A1 | 4/2009 | Shimazaki | |
| 2010/0045733 | A1 | 2/2010 | Mano | |
| 2010/0134548 | A1 | 6/2010 | Saikawa | |
| 2012/0162311 | A1* | 6/2012 | Taira | 347/30 |

FOREIGN PATENT DOCUMENTS

| | | | |
|---|---|---|---|
| JP | H02-102066 | A | 4/1990 |
| JP | 2000-190528 | A | 7/2000 |
| JP | 2001-026112 | A | 1/2001 |
| JP | 2004-155043 | A | 6/2004 |
| JP | 2005-349798 | A | 12/2005 |
| JP | 2006-159717 | A | 6/2006 |
| JP | 2007-136772 | A | 6/2007 |
| JP | 2007-326322 | A | 12/2007 |
| JP | 2008-100405 | | 5/2008 |
| JP | 2008-114511 | | 5/2008 |
| JP | 2009-166246 | A | 7/2009 |
| JP | 2009-262353 | | 11/2009 |
| JP | 2010-137409 | | 6/2010 |
| JP | 2010-149504 | A | 7/2010 |

OTHER PUBLICATIONS

Extended European Search Report dated Mar. 19, 2012 from related European Application No. 11183337.2.

* cited by examiner

*Primary Examiner* — Julian Huffman
(74) *Attorney, Agent, or Firm* — Scully, Scott, Murphy & Presser, P.C.

(57) ABSTRACT

A liquid ejection apparatus including: a liquid-ejection head having ejection openings to eject liquid to record an image on a recording medium; a sealing mechanism configured to selectively establish a sealed state and an unsealed state; a humid-air supply mechanism which supplies a humid air into the ejection space; and a controller, wherein, during the sealed state of the ejection space, the controller controls the humid-air supply mechanism to supply the humid air into the ejection space such that one of a density and a viscosity of the liquid to be ejected from the ejection openings becomes less than a predetermined appropriate value, and then controls the liquid-ejection head such that the liquid having an amount equal to or larger than a set amount is preliminarily ejected prior to the ejection of the liquid onto the recording medium for recording the image on the recording medium, is disclosed.

15 Claims, 11 Drawing Sheets

LIQUID EJECTION APPARATUS AND STORAGE MEDIUM STORING PROGRAM

CROSS REFERENCE TO RELATED APPLICATION

The present application claims priority from Japanese Patent Application No. 2010-283393, which was filed on Dec. 20, 2010, the disclosure of which is herein incorporated by reference in its entirety.

BACKGROUND OF THE INVENTION

1. Field of the Invention

The present invention relates to a liquid ejection apparatus configured to eject liquid from ejection openings and a storage medium storing a program to be executed by the liquid ejection apparatus.

2. Description of the Related Art

There is known a technique in which humidifying liquid held near nozzles of an ink-jet head humidifies ink in the nozzles in order to prevent a viscosity of the ink in the nozzles from increasing.

SUMMARY OF THE INVENTION

In the above-described technique, it is difficult to sufficiently humidify the ink in the nozzles. In order to solve this problem, it is possible to consider that the ink in the nozzles is humidified by bringing an air having high humidity (high humidity air) into contact with an ejection face having the nozzles opened therein. However, when the ink in the nozzles is excessively humidified, an image quality may be deteriorated due to lowering of an ink density, and the ink may be unstably ejected due to lowering of an ink viscosity. Thus, there is a need to accurately adjust humidity of air to be supplied to moderately humidify the ink in the nozzles, making it difficult to execute controls.

This invention has been developed in view of the above-described situations, and it is an object of the present invention to provide: a liquid ejection apparatus capable of ejecting liquid having a proper density or viscosity while restraining of thickening of liquid in ejection openings without any need to accurately adjust a supply of a high humidity air; and a storage medium storing a program to be executed by the liquid ejection apparatus.

The object indicated above may be achieved according to the present invention which provides a liquid ejection apparatus, comprising: a liquid-ejection head having a plurality of ejection openings and configured to eject liquid through the ejection openings to record an image on a recording medium; a sealing mechanism configured to selectively establish (i) a sealed state in which an ejection space in which the ejection openings are open is sealed from an outside and (ii) an unsealed state in which the ejection space is not sealed from the outside; a humid-air supply mechanism configured to supply a humid air into the ejection space; and a controller configured to control the sealing mechanism, the humid-air supply mechanism, and the liquid-ejection head, wherein, during the sealed state of the ejection space established by the sealing mechanism, the controller controls the humid-air supply mechanism to supply the humid air into the ejection space such that one of a density and a viscosity of the liquid to be ejected from the ejection openings becomes less than a predetermined appropriate value, and then controls the liquid-ejection head such that the liquid having an amount equal to or larger than a set amount is preliminarily ejected through the ejection openings as a preliminary ejection prior to the ejection of the liquid onto the recording medium for recording the image on the recording medium.

The object indicated above may also be achieved according to the present invention which provides a liquid ejection apparatus, comprising: a liquid-ejection head having a plurality of ejection openings and configured to eject liquid through the ejection openings to record an image on a recording medium; a sealing mechanism configured to selectively establish (i) a sealed state in which an ejection space opposed to the ejection openings is sealed from an outside and (ii) an unsealed state in which the ejection space is not sealed from the outside; a humid-air supply mechanism configured to supply a humid air into the ejection space; a humidity detecting device configured to detect a humidity in the ejection space; and a controller configured to control the sealing mechanism, the humid-air supply mechanism, and the liquid-ejection head, wherein, during the sealed state of the ejection space established by the sealing mechanism, the controller controls the humid-air supply mechanism to supply the humid air into the ejection space such that the humidity in the ejection space becomes higher than a predetermined appropriate value, and then controls the liquid-ejection head such that the liquid having an amount equal to or larger than a set amount is preliminarily ejected through the ejection openings as a preliminary ejection prior to the ejection of the liquid onto the recording medium for recording the image on the recording medium, and wherein the controller is configured to set the set amount on the basis of the appropriate humidity and the humidity detected by the humidity detecting device.

The object indicated above may also be achieved according to the present invention which provides a nonvolatile storage medium storing a program to be executed by a liquid ejection apparatus, the liquid ejection apparatus comprising: a liquid-ejection head having a plurality of ejection openings and configured to eject liquid through the ejection openings to record an image on a recording medium; a sealing mechanism configured to selectively establish (i) a sealed state in which an ejection space in which the ejection openings are open is sealed from an outside and (ii) an unsealed state in which the ejection space is not sealed from the outside; and a humid-air supply mechanism configured to supply a humid air into the ejection space, the program comprising: controlling, during the sealed state of the ejection space established by the sealing mechanism, the humid-air supply mechanism to supply the humid air into the ejection space such that one of a density and a viscosity of the liquid to be ejected from the ejection openings becomes less than a predetermined appropriate value; and then controlling the liquid-ejection head such that the liquid having an amount equal to or larger than a set amount is preliminarily ejected through the ejection openings as a preliminary ejection prior to the ejection of the liquid onto the recording medium for recording the image on the recording medium.

In the liquid ejection apparatuses and the storage medium as described above, the humid air is supplied into the ejection space such that one of the density and the viscosity of the liquid to be ejected from the ejection openings is less than the predetermined appropriate value, thereby establishing a state in which the liquid in the ejection openings is excessively humidified. Then, the liquid having the amount equal to or larger than the set amount is preliminarily ejected through the ejection openings as the preliminary ejection prior to the ejection of the liquid onto the recording medium for recording the image on the recording medium, whereby low density liquid excessively humidified in the ejection openings is discharged. As a result, it is possible to restrain thickening of the liquid in the ejection openings without fine adjustment of a supply amount of the air. Thus, the liquid having an appropriate density can be ejected in the recording.

BRIEF DESCRIPTION OF THE DRAWINGS

The objects, features, advantages, and technical and industrial significance of the present invention will be better understood by reading the following detailed description of an embodiment of the invention, when considered in connection with the accompanying drawings, in which.

DETAILED DESCRIPTION OF THE EMBODIMENT

Hereinafter, there will be described an embodiment of the present invention by reference to the drawings.

Figure 1:
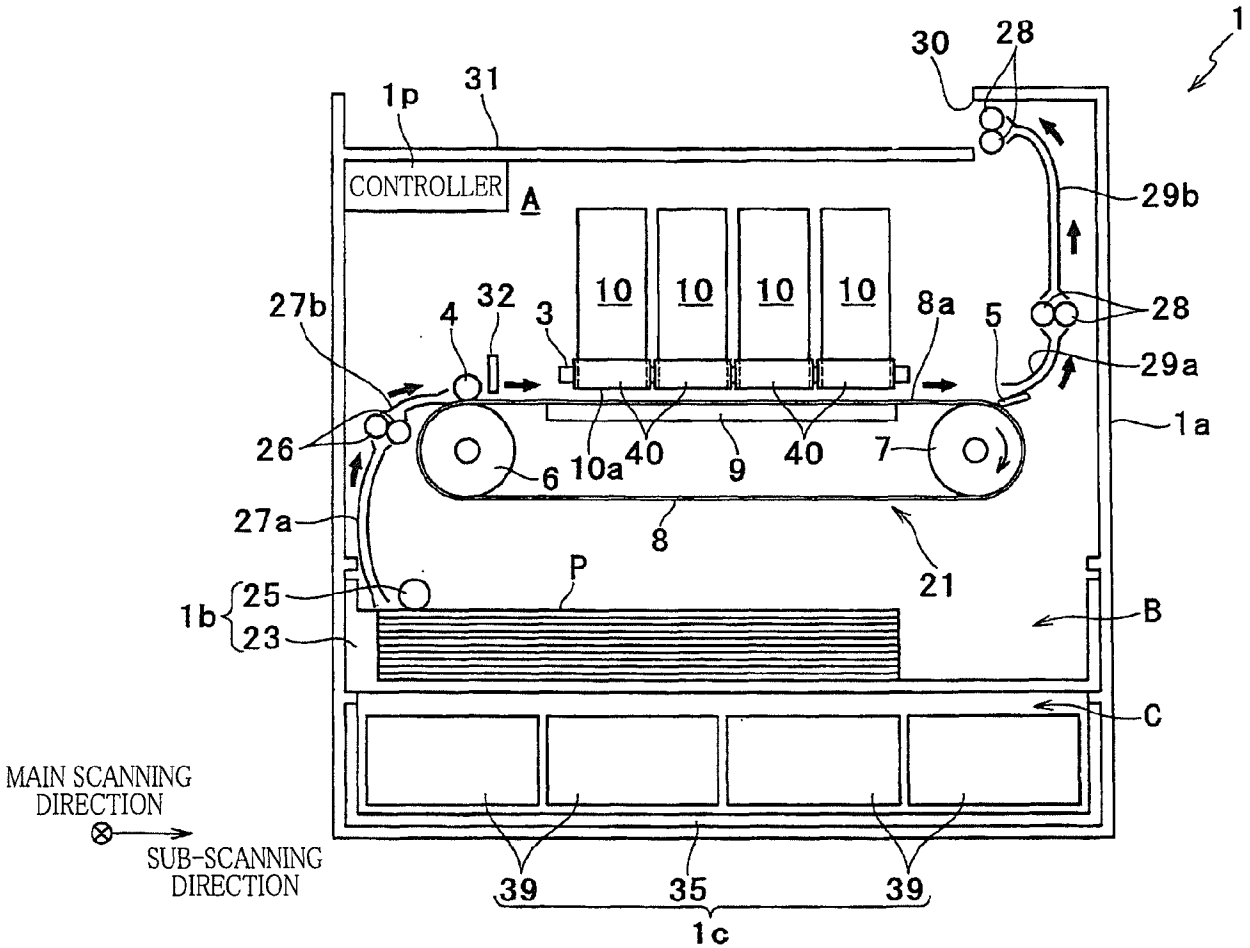
FIG. 1 is a side view generally showing an internal structure of an ink jet printer as an embodiment of the present invention.

First, there will be explained, with reference to FIG. 1, an overall construction of an ink-jet printer 1 as an embodiment of the present invention.

The printer 1 includes a casing 1*a* having a rectangular parallelepiped shape. A sheet-discharge portion 31 is provided on a top plate of the casing 1*a*. An inner space of the casing 1*a* is divided into spaces A, B, and C in order from an upper side thereof. In the spaces A and B is formed a sheet conveyance path continuous to the sheet-discharge portion 31. In the space C are accommodated ink cartridges 39 each as an ink supply source for ink jet heads 10 each as an example of a liquid-ejection head.

In the space A, there are arranged the four heads 10, a conveyance unit 21 for conveying a sheet P as an example of a recording medium, a guide unit for guiding the sheet P, a humidifying mechanism 50 (see FIG. 5) used for a humidifying maintenance, and so on. In an upper portion of the space A, there is disposed a controller 1*p* configured to control operations of components of the printer 1 to control an overall operation of the printer 1.

On the basis of image data transmitted from an external device, the controller 1*p* controls: a conveyance operation of components of the printer 1 for conveying the sheet P; an ink ejecting operation synchronized with the conveyance of the sheet P; a maintenance operation for recovering or maintaining an ejection characteristic; and so on. The maintenance operation includes flushing, purging, wiping, humidifying maintenance, and so on. The flushing is an operation for forcibly ejecting ink from ejection opening(s) 14*a* by driving actuators of the head 10 on the basis of flushing data that is different from the image data, and this flushing is performed for a part or all of the ejection openings 14*a*. The purging is an operation for forcibly ejecting the ink from all of the ejection openings 14*a* by applying a pressure to the ink in the head 10 by, e.g., a pump. The wiping is an operation for wiping foreign matters on ejection faces 10*a* by a wiper after the flushing or the purging. The humidifying maintenance is an operation for supplying humid air into ejection spaces S1 (see FIG. 5) defined by respective caps 40. It is noted that the humidifying maintenance will be explained in more detail later.

The conveyance unit 21 includes (a) belt rollers 6, 7, (b) an endless conveyance belt 8 as an example of an opposed member wound around the rollers 6, 7, (c) a nip roller 4 and a peeling plate 5 respectively disposed on opposite sides (outsides) of the conveyance belt 8, (d) a platen 9 disposed inside the conveyance belt 8, and so on. The belt roller 7 is a drive roller that is rotated in a clockwise direction in FIG. 1 by a conveyance motor, not shown. The conveyance belt 8 runs or is circulated along bold arrow in FIG. 1 in accordance with the rotation of the belt roller 7. The belt roller 6 is a driven roller that is rotated in the clockwise direction in FIG. 1 in accordance with the circulation of the conveyance belt 8. The nip roller 4 is disposed so as to face the belt roller 6 and press the sheet P supplied from an upstream side in a conveyance direction, onto a support face 8*a* of the conveyance belt 8 as an outer circumferential face or an opposed face opposed to the ejection openings 14*a*. The sheet P is then conveyed toward the belt roller 7 in accordance with the circulation of the conveyance belt 8 while being supported on the support face 8*a*. The peeling plate 5 is disposed so as to face the belt roller 7, and peels the sheet P from the support face 8*a* and then guides the sheet P toward a downstream side in the conveyance direction. The platen 9 is disposed so as to face the four heads 10 and support an upper portion of the conveyance belt 8 from an inside thereof.

Each of the heads 10 is a line head having a generally rectangular parallelepiped shape elongated in a main scanning direction in which each head 10 reciprocates. A lower face of each head 10 is the ejection face 10*a* having a multiplicity of the ejection openings 14*a* (see FIGS. 3 and 4) opened therein. In a recording operation, the four heads 10 eject inks of respective four colors, namely, black, magenta, cyan, and yellow from the respective ejection faces 10*a*. The four heads 10 are arranged in a sub-scanning direction at predetermined pitches and are supported by the casing 1*a* via a head holder 3. The head holder 3 supports the heads 10 such that the ejection faces 10*a* face the support face 8*a* of the upper portion of the conveyance belt 8 with a specific space therebetween for the recording operation. On the head holder 3 are provided the circular caps 40 each for covering an outer region of the ejection face 10*a* of a corresponding one of the heads 10. Specific constructions of the heads 10 and the head holder 3 will be explained later. Here, the sub-scanning direction is a direction parallel to the conveyance direction in which the sheet P is conveyed by the conveyance unit 21, and the main scanning direction is a direction parallel to a horizontal plane and perpendicular to the sub-scanning direction.

The guide unit includes an upstream guide portion and a downstream guide portion disposed with the conveyance unit 21 interposed therebetween. The upstream guide portion includes two guides 27*a*, 27*b* and a pair of conveyance rollers 26. The guide portion connects between a sheet-supply unit 1*b* (which will be described below) and the conveyance unit 21. The downstream guide portion includes two guides 29*a*, 29*b* and two pairs of conveyance rollers 28. This guide portion connects between the conveyance unit 21 and the sheet-discharge portion 31.

In the space B is disposed the sheet-supply unit 1*b* that is mountable on and removable from the casing 1*a*. The sheet-supply unit 1*b* includes a sheet-supply tray 23 and a sheet-supply roller 25. The sheet-supply tray 23 has a box-like shape opening upward so as to accommodate various sizes of the sheet P. The sheet-supply roller 25 is rotated to supply an uppermost one of the sheets P in the sheet-supply tray 23 toward the upstream guide portion.

As described above, in the spaces A, B is formed the sheet conveyance path extending from the sheet-supply unit 1*b* to the sheet-discharge portion 31 via the conveyance unit 21. On the basis of a recording command transmitted from the external device, the controller 1*p* drives a plurality of motors such as a sheet-supply motor, not shown, for the sheet-supply roller 25, a sheet-conveyance motor, not shown, for the conveyance rollers of each of the upstream and downstream guide portions, the above-described conveyance motor, and the like. The sheet P supplied from the sheet-supply tray 23 is supplied to the conveyance unit 21 by the conveyance rollers 26. When the sheet P passes through positions just under the heads 10 in the sub-scanning direction, the heads 10 eject the inks of the respective four colors in order from the respective ejection faces 10*a*, to record or form a color image on the sheet P. The ink ejection is performed on the basis of a detection signal outputted from a sheet sensor 32. The sheet P is then peeled by the peeling plate 5 and conveyed upward by the conveyance rollers 28. The sheet P is then discharged onto the sheet-discharge portion 31 through an opening 30.

In the space C, an ink unit 1*c* is disposed so as to be mountable on and removable from the casing 1*a*. The ink unit 1*c* includes a cartridge tray 35 and the four cartridges 39 accommodated in the tray 35 side by side. The inks stored in the respective cartridges 39 are to be supplied to the respective heads 10 via respective ink tubes, not shown.

There will be next explained the construction of each head 10 with reference to FIGS. 2-4 and 7 in detail. It is noted that, in FIG. 3, pressure chambers 16 and apertures 15 are illustrated by solid lines for easier understanding purposes though these elements are located under actuator units 17 and thus should be illustrated by broken lines. It is further noted that, since the four heads 10 have the same construction, the following explanation will be given for one of the heads 10 for the sake of simplicity.

The head 10 includes a reservoir unit 11, a channel unit 12 (see FIG. 7), the eight actuator units 17 (see FIG. 2) fixed to an upper face 12*x* of the channel unit 12, a Flexible Printed Circuit (FPC) 19 (see FIG. 4) bonded to each of the actuator units 17 and so on which are stacked on one another in a vertical direction. In the reservoir unit 11 are formed ink channels including a reservoir that temporarily stores the ink supplied from the cartridge 39 (see FIG. 1). In the channel unit 12 are formed ink channels each extending from a corresponding one of openings 12*y* of the upper face 12*x* (see FIG. 2) of the channel unit 12 to a corresponding one of the ejection openings 14*a* formed in a lower face of the channel unit 12 (i.e., the ejection face 10*a*). The actuator units 17 include piezoelectric actuators for the respective ejection openings 14*a*.

Protruding portions and recessed portions are formed on and in a lower face of the reservoir unit 11. The protruding portions are bonded to the upper face 12*x* of the channel unit 12 at areas on which no actuator units 17 are disposed (noted that the areas include the openings 12*y* and are enclosed with two-dot chain lines in FIG. 2). A distal end face of each of the protruding portions has an opening connected to the reservoir and facing a corresponding one of the openings 12*y* of the channel unit 12. As a result, the reservoir and individual ink channels 14 are communicated with each other via the above-described openings. The recessed portions face the upper face 12*x* of the channel unit 12, faces of the respective actuator units 17, and a face of the FPC 19 with slight spaces formed therebetween.

Figure 2:
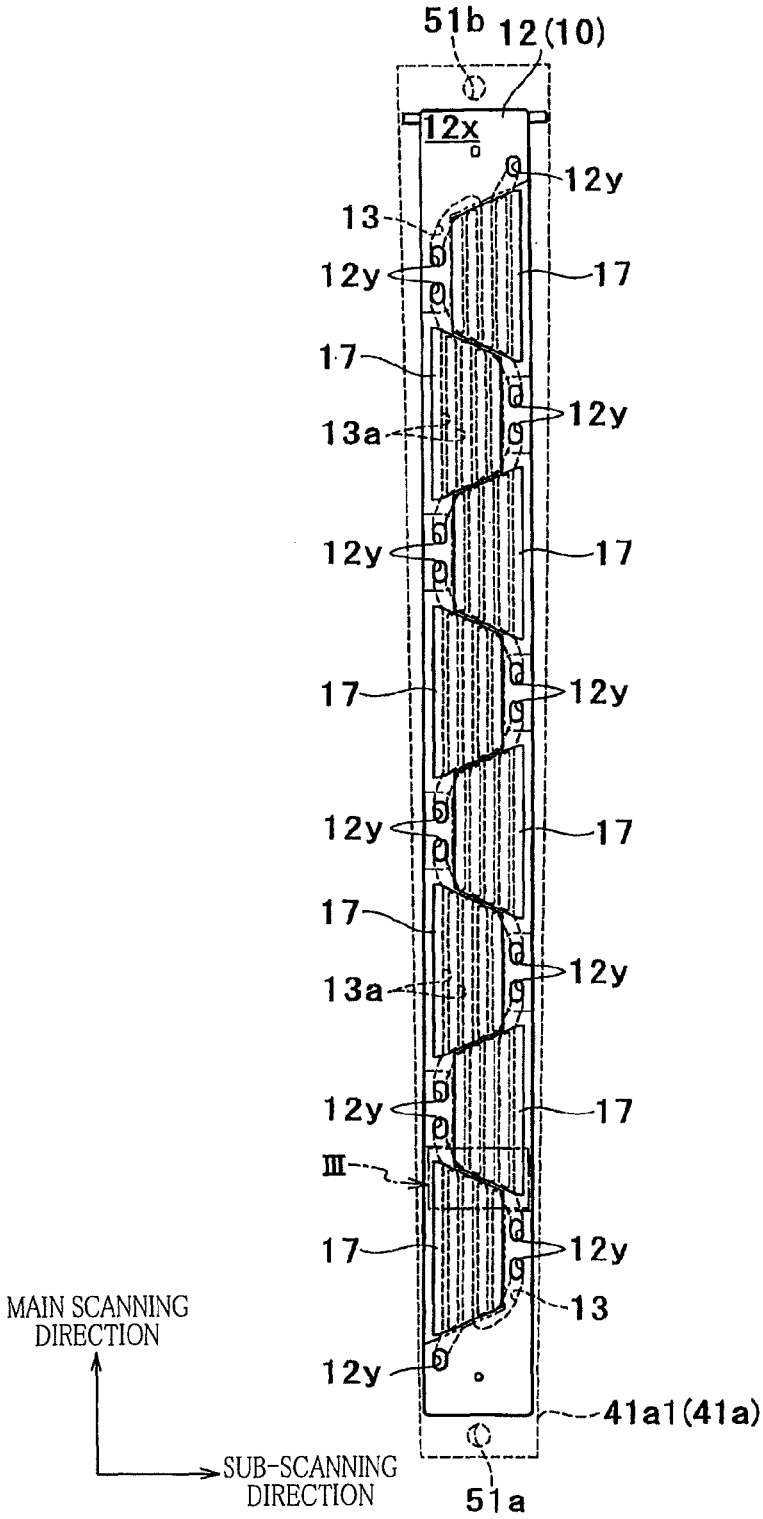
FIG. 2 is a plan view showing a channel unit and actuator units of each ink-jet head of the printer in FIG. 1.
Figure 3:
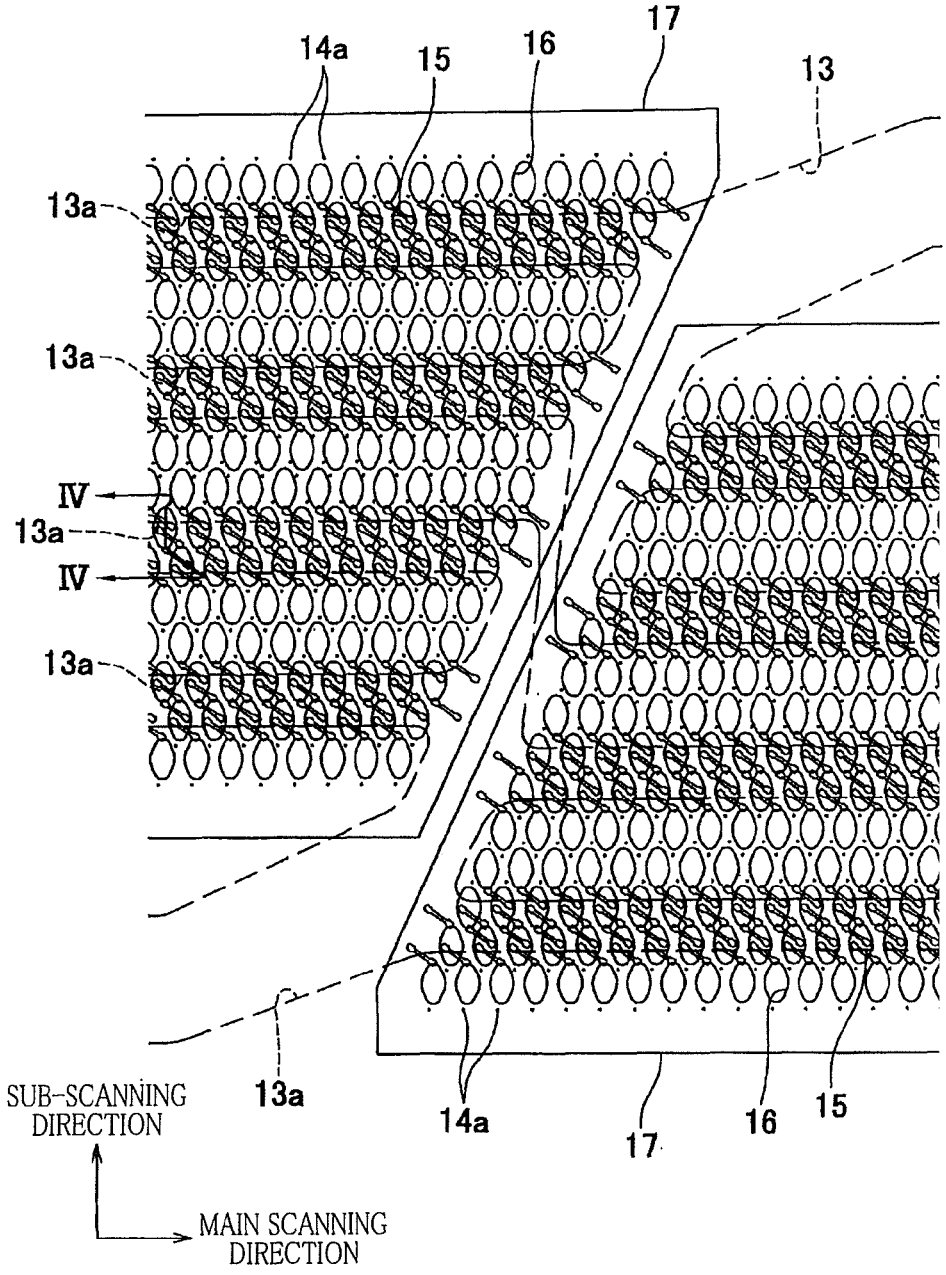
FIG. 3 is an enlarged view showing an area III enclosed by one-dot chain line in FIG. 2.
Figure 4:
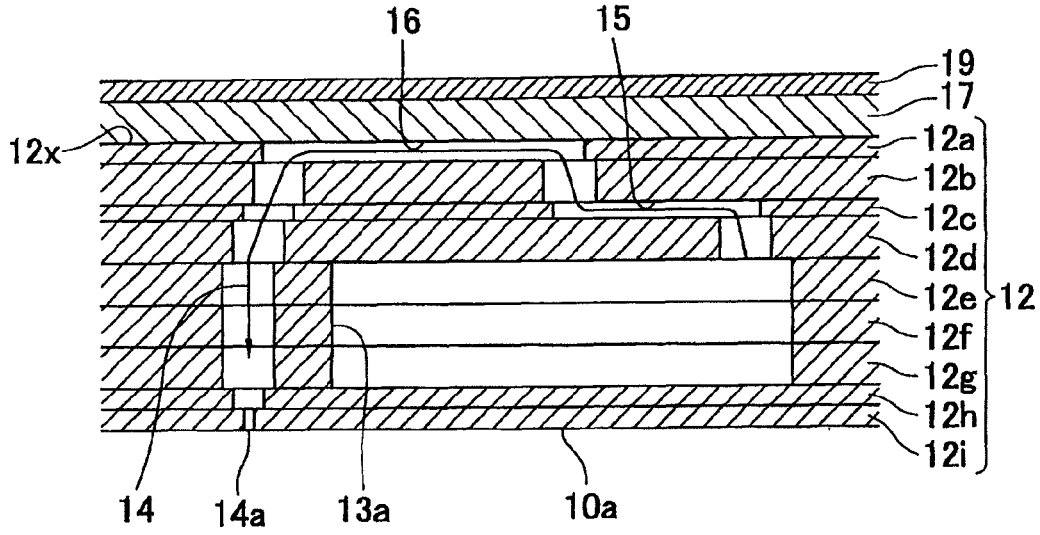
FIG. 4 is a partial cross-sectional view taken along line IV-IV in FIG. 3.

The channel unit 12 is a stacked body constituted by nine metal rectangular plates 12*a*-12*i* (see FIG. 4) having generally the same size and bonded to one another. As shown in FIGS. 2-4, the channel unit 12 includes: manifold channels 13 each having a corresponding one of the openings 12*y* as one end; sub-manifold channels 13*a* each branched from a corresponding one of the manifold channels 13; the individual ink channels 14 respectively extending from outlets of the sub-manifold channels 13*a* to the ejection openings 14*a* via the pressure chambers 16. As shown in FIG. 4, the individual channel 14 is formed for each ejection opening 14*a* so as to have the aperture 15 functioning as a restrictor for adjusting a channel resistance. Generally rhombic openings for respectively exposing the pressure chambers 16 are formed in matrix in areas on the upper face 12*x* to which the actuator units 17 are respectively bonded. The ejection openings 14*a* are formed in matrix in the same pattern as the pressure chambers 16, in the lower face (i.e., the ejection face 10*a*) at areas opposed to the areas on the upper face 12*x* to which the actuator units 17 are respectively bonded.

As shown in FIG. 2, the actuator units 17 each having a trapezoid shape are arranged on the upper face 12*x* in two arrays in a staggered configuration. As shown in FIG. 3, each of the actuator units 17 covers the multiplicity of the pressure chambers 16 formed under the actuator unit 17. Though not shown, each of the actuator units 17 includes: a plurality of piezoelectric layers expanding over the multiplicity of the pressure chambers 16; and electrodes interposing the piezoelectric layers in a thickness direction of the actuator units 17. The electrodes include: a common electrode common for the pressure chambers 16 and individual electrodes provided for the respective pressure chambers 16. The individual electrodes are formed on a face of an uppermost one of the piezoelectric layers.

The FPC 19 has wirings corresponding to the respective electrodes of the actuator units 17, and a driver IC, not shown, is mounted on the wirings. The FPC 19 is fixed at one end thereof to the actuator units 17 and at the other end to a control board, not shown, of the head 10, which is disposed on an upper side of the reservoir unit 11. Under the control of the controller 1*p* (see FIG. 1), the FPC 19 sends the driver IC various drive signals outputted from the control board and sends the actuator units 17 signals produced by the driver IC.

Figure 5:
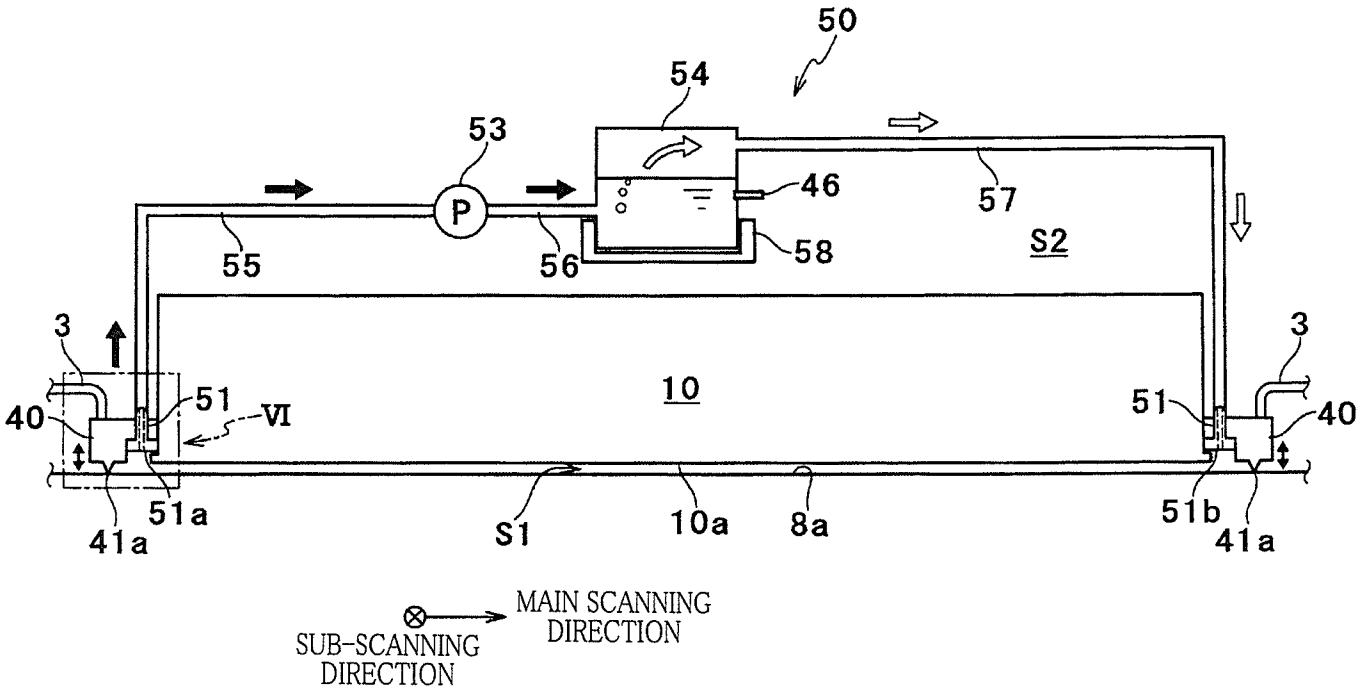
FIG. 5 is a schematic view showing a head holder and a humidifying mechanism of the printer in FIG. 1.
Figure 6:
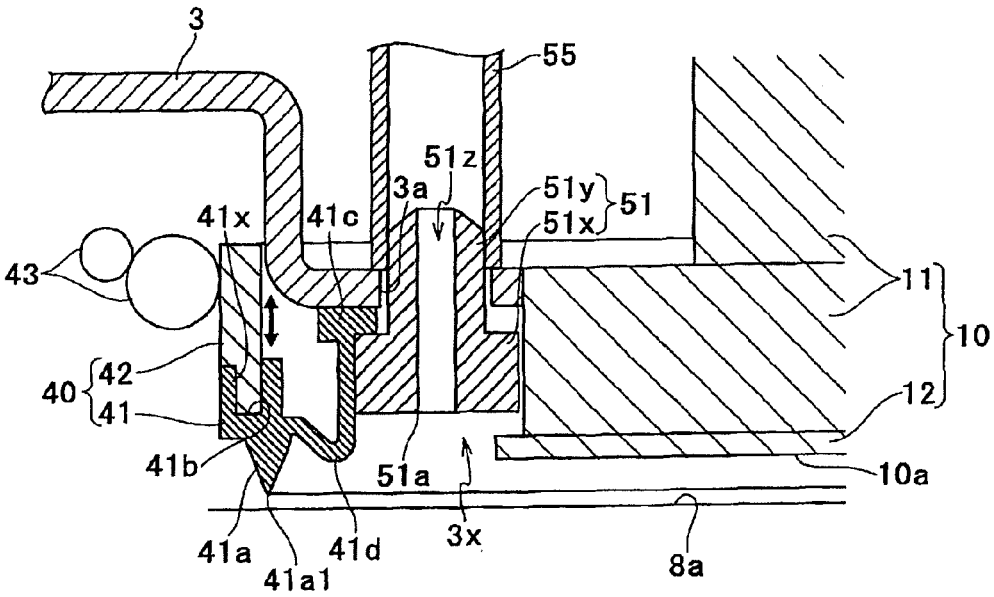
FIG. 6 is a partial cross-sectional view showing an area VI enclosed with a one-dot chain line in FIG. 5.

There will be next explained a construction of the head holder 3 with reference to FIGS. 2, 5, and 6.

The head holder 3 is a frame made of a metal, for example. For each head 10, the cap 40 and a pair of joints 51 are mounted on the head holder 3. Recessed portions 3*x* are formed in a face of the head holder 3. The pair of joints 51 are disposed in the respective recessed portions 3*x*.

As shown in FIG. 5, each pair of the joints 51 respectively constitute one and the other ends of the circulation channel of the humidifying mechanism 50 and are respectively disposed near one and the other ends of a corresponding one of the heads 10 in the main scanning direction. In the humidifying maintenance, an air is sucked through an opening (outlet opening) 51*a* formed in a lower face of one of the pair of the joints 51 (the left joint 51 in FIG. 5), and a humid air is supplied through an opening (inlet opening) 51*b* formed in a lower face of the other of the pair of the joints 51.

As shown in FIG. 6, each of the joints 51 has a generally cylindrical shape and has a basal end portion 51*x* and a distal end portion 51*y* extending from the basal end portion 51*x*. A hollow space 51*z* is formed through the basal end portion 51*x* and the distal end portion 51*y* in the vertical direction. The basal end portion 51*x* and the distal end portion 51*y* have different outside diameters from each other, specifically, the basal end portion 51*x* has a greater outside diameter than that of the distal end portion 51*y*. The hollow space 51*z* has a uniform diameter along the vertical direction. A diameter of an upper end portion of the distal end portion 51*y* decreases from a lower side to an upper side thereof, that is, the upper end portion of the distal end portion 51*y* is tapered. This facilitates a connection of one end of a tube 55 or 57 to the distal end portion 51*y*.

The joints 51 are fixed to the head holder 3 in a state in which the distal end portions 51*y* are inserted and fitted in respective through holes 3*a* of the head holder 3. The through holes 3*a* are formed at respective positions at which the joints 51 are disposed on the head holder 3, that is, the through holes 3*a* are respectively formed near one and the other ends of the head 10 in the main scanning direction. The outside diameter of the distal end portion 51*y* is one size smaller than that of the through hole 3*a*. Thus, a small space is formed between an outer circumferential face of the distal end portion 51*y* and a wall face defining the through hole 3*a* of the head holder 3. This space is sealed by, e.g., a sealing material when the joint 51 is fixed to the head holder 3.

Each cap 40 has a circular shape in plan view for enclosing an outer peripheral area of the ejection face 10*a* of the corresponding head 10. The cap 40 includes: an elastic member 41 supported by the head holder 3 via a fixed portion 41*c*; and a movable member 42 movable upward and downward.

The elastic member 41 is formed of an elastic material such as a rubber and includes (a) a base portion 41*x*, (b) a projecting portion 41*a* projecting downward from a lower face of the base portion 41*x* so as to have an inverted triangle shape in cross section, (c) the fixed portion 41*c* having a T-shape in cross section and fixed to the head holder 3, and (e) a connecting portion 41*d* for connecting the base portion 41*x* and the fixed portion 41*c* to each other. The elastic member 41 has a circular shape in plan view for enclosing the outer peripheral area of the ejection face 10*a*. An upper end portion of the fixed portion 41*c* is fixed to the head holder 3 by adhesive, for example. The fixed portion 41*c* is sandwiched near the through hole 3*a* between the head holder 3 and the basal end portion 51*x* of the joint 51. The connecting portion 41*d* extends from a lower end of the fixed portion 41*c* and curves to an outside in a direction away from the ejection face 10*a* in plan view, so as to be connected to a lower end of the base portion 41*x*. The connecting portion 41*d* is deformable so as to be deformed according to the upward and downward movement of the movable member 42. An upper face of the base portion 41*x* has a recessed portion 41*b* that is fitted on a lower end of the movable member 42.

The movable member 42 is formed of a rigid material and has a circular shape in plan view for enclosing an outer peripheral area of the ejection face 10*a* of the head 10 like the elastic member 41. The movable member 42 is supported by the head holder 3 via the elastic member 41 so as to be movable relative to the head holder 3 in the vertical direction. Specifically, the movable member 42 is connected to a plurality of gears 43 and moved upward and downward by the gears 43 rotated by a drive power outputted from an up-down motor 44 (see FIG. 8) under the control of the controller 1*p*. In this upward and downward movement of the movable member 42, the base portion 41*x* is also moved upward and downward with the movable member 42 because the lower end of the movable member 42 is fitted in the recessed portion 41*b* of the elastic member 41. When the movable member 42 is moved upward and downward, the projecting portion 41*a* is also moved upward and downward in the state in which the fixed portion 41*c* is fixed to the head holder 3. As a result, a position of a distal end 41*a*1 of the projecting portion 41*a* relative to the ejection face 10*a* in the vertical direction is changed.

According to the upward and downward movement of the movable member 42, the projecting portion 41*a* is selectively positioned at a contact position (see FIG. 5) at which the distal end 41*a*1 is held in contact with the support face 8*a* of the conveyance belt 8 and at a distant position (see FIG. 6) at which the distal end 41*a*1 is distant from the support face 8*a* of the conveyance belt 8. As shown in FIG. 5, when the projecting portion 41*a* is positioned at the contact position, a capped state (sealed state) is established in which the ejection space S1 formed between the ejection face 10*a* and the support face 8*a* is isolated from or does not communicate with an outside space S2. As shown in FIG. 6, when the projecting portion 41*a* is positioned at the distant position, an uncapped state (unsealed state) is established in which the ejection space S1 communicates with the outside space S2. It is noted that the ejection space S1 is a space facing the ejection face 10*a*, in other words, the ejection space S1 is the space in which the plurality of the ejection openings 14*a* formed in the ejection face 10*a* are opened, in other words, the ejection space S1 is the space to which the ink is ejected from the plurality of the ejection openings 14*a*.

The projecting portion 41*a* is distant from the ejection face 10*a* over an entire perimeter of the ejection face 10*a* (i.e., the lower face of the head 10 in FIG. 2) in plan view. Further, the projecting portion 41*a* has a generally rectangular shape in plan view so as to enclose the ejection face 10*a*. In view of the above, each cap 40 and the support face 8*a* are an example of a sealing mechanism.

Figure 7:
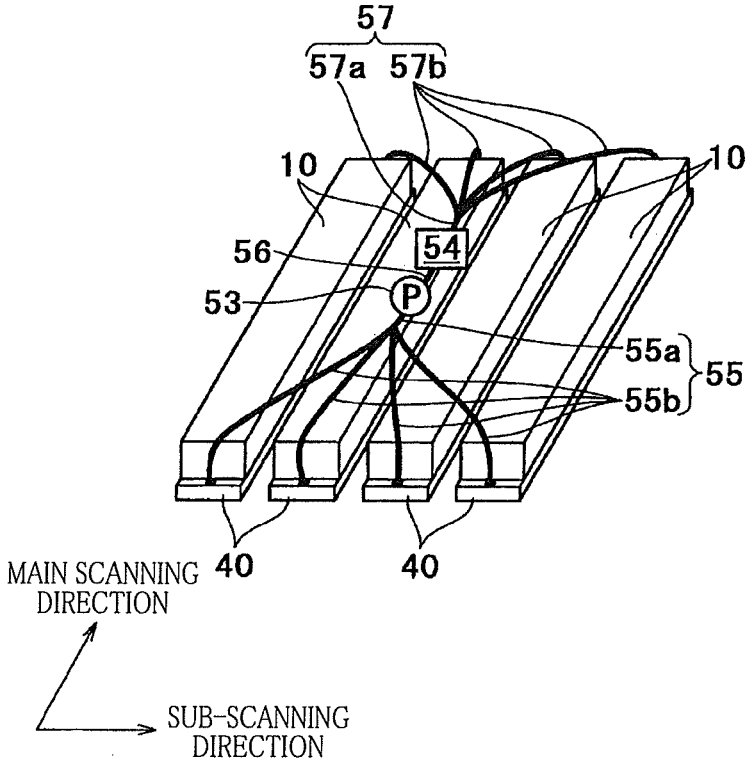
FIG. 7 is a schematic view showing connection between all the heads of the printer in FIG. 1 and a humidifying mechanism.

There will be next explained a construction of the humidifying mechanism 50 with reference to FIGS. 5 and 7.

As shown in FIG. 5, the humidifying mechanism 50 as an example of a humid-air supply mechanism includes the joints 51, the tubes 55, 57, a tube 56, a pump 53, and a tank 54. Although the pair of the joints 51 are provided for each head 10, as shown in FIG. 7, the single pump 53 and the single tank 54 are provided in the printer 1, that is, the single pump 53 and the single tank 54 are provided for the four heads 10 (see FIG. 7). The tube 55 includes a main portion 55*a* common for the four heads 10 and four branch portions 55*b* branched from the main portion 55*a* and each extending to a corresponding one of the joints 51. Likewise, the tube 57 includes a main portion 57*a* common for the four heads 10 and four branch portions 57*b* branched from the main portion 57*a* and each extending to a corresponding one of the joints 51.

One ends of the tube 55 (distal ends of the respective branch portions 55*b*) are respectively fitted on the distal end portions 51*y* of the joints 51 (left joints 51 in FIG. 5) provided on the respective heads 10. The other end of the tube 55 (an end of the main portion 55*a* opposite to the branch portions 55*b*) is connected to the pump 53. That is, the tube 55 communicably connects the pump 53 and the hollow space 51*z* of one of each pair of the joints 51 to each other. The tube 56 communicably connects the pump 53 and the tank 54 to each other. One ends of the tube 57 (distal ends of the respective branch portions 57*b*) are respectively fitted on the distal end portions 51*y* of the joints 51 (right joints 51 in FIG. 5) provided on the respective heads 10. The other end of the tube 57 (an end of the main portion 57*a* opposite to the branch portions 57*b*) is connected to the tank 54. That is, the tube 57 communicably connects the tank 54 and the hollow space 51*z* of the other of each pair of the joints 51 to each other.

The tank 54 stores water in its lower space and stores in its upper space the humid air humidified by the water stored in the lower space. The tube 56 is connected to a side face of the tank 54 below a water surface (i.e., an upper surface of the water), that is, the tube 56 is connected to the lower space of the tank 54. The tube 57 is connected to another side face of the tank 54 above the water surface, that is, the tube 57 communicates with the upper space of the tank 54. It is noted that a check valve, not shown, is provided on the tube 56 for preventing the water in the tank 54 from flowing into the pump 53, resulting in that the air flows only in a direction indicated by arrows in FIG. 5. A water-temperature sensor 46 is attached to the tank 54 for measuring a temperature of the stored water, and a heater 58 is provided near the tank 54 for heating the water stored in the tank 54. As will be described below, the heater 58 adjusts humidity of the air stored in the upper space of the tank 54 by heating the water in the tank. It is noted that, when an amount of the water stored in the tank 54 becomes small, water is replenished from a replenish tank, not shown.

Figure 8:
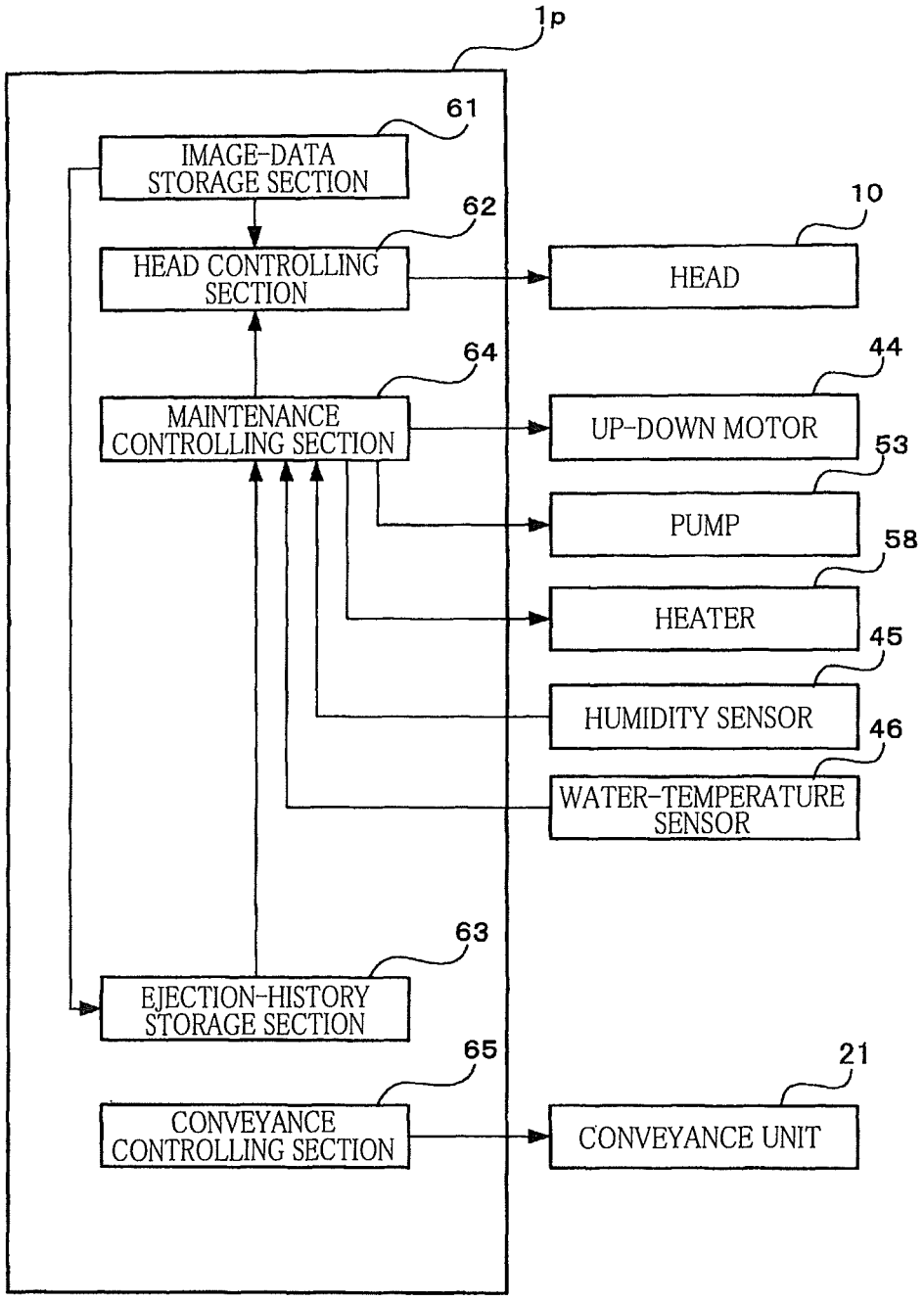
FIG. 8 is a block diagram showing functions of a controller of the printer in FIG. 1.

There will be next explained the controller 1*p*. The controller 1*p* includes a Central Processing Unit (CPU); a nonvolatile memory for rewritably storing programs executed by the CPU and data used for these programs; and a Random Access Memory (RAM) for temporarily storing the date upon the execution of the program. The controller 100 includes various functional sections which are constituted by cooperation of these hardwares and softwares in the nonvolatile memory with each other. These programs are stored in various storage media such as a flexible disc, a CD-ROM, and a memory card, and installed from these storage medium into the nonvolatile memory. It is noted that control programs stored in the storage medium may be programs to be executed directly by the CPU and may be programs that become executable by being installed to the nonvolatile memory. Further, the control programs may be encrypted and/or compressed. As shown in FIG. 8, the controller 1*p* includes an image-data storage section 61, a head controlling section 62, an ejection-history storage section 63 as an example of an elapsed-time storing section, a maintenance controlling section 64, and a conveyance controlling section 65.

The image-data storage section 61 stores the image data based on which an image is recorded on the sheet P. The conveyance controlling section 65 is configured to control the conveyance unit 21 such that the sheet P is conveyed through the sheet conveyance path at a predetermined speed. The head controlling section 62 is configured to control the heads 10 such that the image is recorded on the sheet P conveyed by the conveyance unit 21 on the basis of the image data stored in the image-data storage section 61, and such that the flushing is performed in the maintenance operation.

The ejection-history storage section 63 stores, as an ejection history, a time elapsed from the last ejection of the ink for each of the ejection openings 14*a*.

The maintenance controlling section 64 is configured to control the pump 53 of the humidifying mechanism 50, the up-down motor 44 for moving upward and downward the movable members 42 (the distal ends 41*a*1 of the respective projecting portions 41*a*), and the heater 58 in order to perform the humidifying maintenance. Further, the maintenance controlling section 64 is configured to control the heads 10 via the head controlling section 62. The humidifying maintenance is an operation in which the flushing is performed after the ejection spaces S1 have been humidified in the capped state, and the humidifying maintenance is started when a predetermined length of time has passed from the last recording. It is noted that the heads 10, the head holder 3, and the conveyance belt 8 are located at their respective predetermined positions during operations of the humidifying maintenance which will be described below. The head holder 3 is positioned while holding the heads 10 such that a predetermined space suitable for the recording is formed between the ejection faces 10*a* and the support face 8*a*.

In the humidifying maintenance, the maintenance controlling section 64 initially rotates the gears 43 to lower the movable member 42. The projecting portion 41*a* is located at the distant position (see FIG. 6) in the recording but moved to the contact position (see FIG. 5) by the downward movement of the movable member 42. As a result, the ejection spaces S1 are sealed to establish the capped state. It is noted that, in a standby state or a sleep (suspended) state other than the recording, the maintenance controlling section 64 moves the projecting portion 41*a* to the contact position to establish the capped state.

The maintenance controlling section 64 then drives the pump 53 to suck the air in each ejection space S1 through the opening 51*a* of the corresponding joint 51. In this operation, the air sucked through the opening 51*a* is moved to the pump 53 through the hollow space 51*z* of the joint 51 and the tube 55 and then to the tank 54 through the tube 56. The air is supplied to the lower space of the tank 54 (on a lower side of the water surface). The air humidified by the water in the tank 54 (the humid air) is discharged from the upper space of the tank 54. At this time, the humidity of the air discharged from the upper space of the tank 54 is a value near 100%. This humid air is supplied to the ejection space S1 from the opening 51*b* of the joint 51 through the tube 57. In FIG. 5, boldface arrows indicate the flow of the air before the humidification, and outline (white) arrows indicate the flow of the air after the humidification. In response to the above-described driving of the pump 53, the maintenance controlling section 64 controls switching valves, not shown, and so on provided on the branch portions 55*b*, 57*b* shown in FIG. 7 to selectively adjust the flows of the air in the branch portions 55*b*, 57*b*. Further, the maintenance controlling section 64 controls the heater 58 on the basis of a result of the detection of the temperature by the water-temperature sensor 46 to adjust the humidity of the humid air to be supplied from the opening 51*b* to the ejection space S1. That is, the maintenance controlling section 64 controls the heater 58 to increase the humidity of the air to a desired one.

Figure 9:
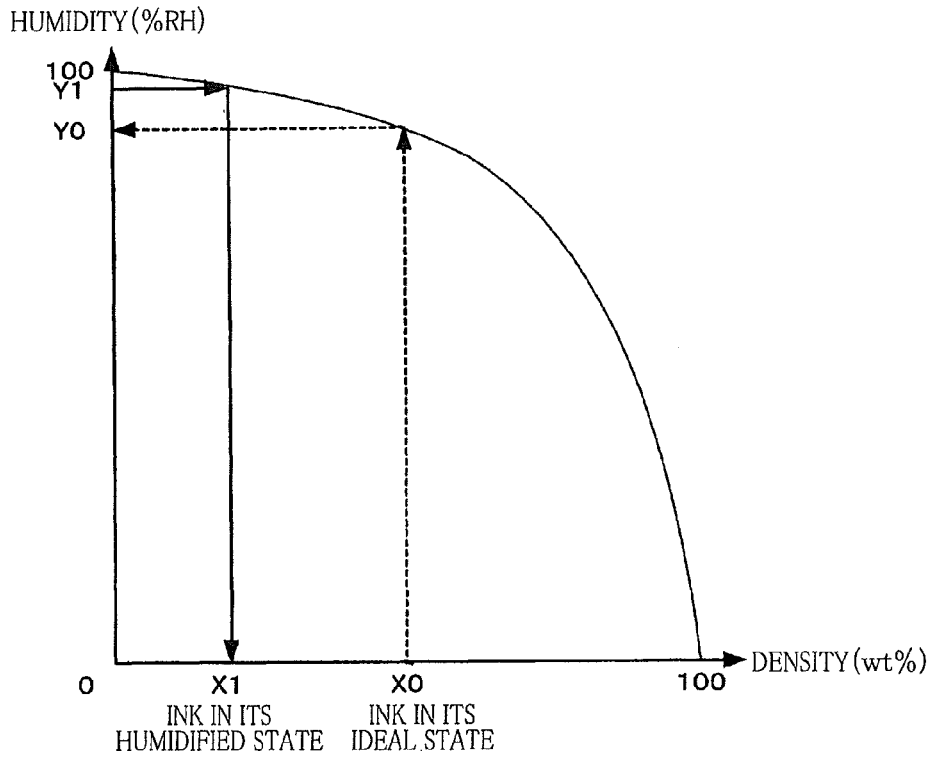
FIG. 9 is a graph showing a relationship between a density of ink ejected from the ink-jet head shown in FIG. 2 and humidity of an ejection space.

The supply of the humid air from the opening 51*b* into the ejection space S1 increases humidity in the ejection space S1. As shown in FIG. 9, the ink density of the ejection openings 14*a* lowers with an increase in the humidity in the ejection space S1. It is noted that FIG. 9 indicates a relationship between the humidity and the ink density in equilibrium. The maintenance controlling section 64 drives the pump 53 such that the density of the ink in the ejection openings 14*a* becomes X1 that is less than an appropriate density (predetermined appropriate value) X0 in which the ink is stably ejected from the ejection openings 14*a* (the ink is in its ideal state), in other words, such that the humidity in the ejection space S1 becomes Y1 that is higher than an appropriate humidity (predetermined appropriate value) Y0 corresponding to the ink density X0. It is noted that the humidity of the air discharged from the upper space of the tank 54 is a humidity higher than the appropriate humidity Y0 (for example, the humidity of the air discharged from the upper space of the tank 54 is the above-described value near 100%).

The maintenance controlling section 64 determines an ink ejection amount upon the flushing (explained below) for each of the ejection openings 14*a*. From a viewpoint of saving the ink amount, only low density ink whose density has been lowered is preferably ejected from the ejection openings 14*a* in the flushing. A volume of this low density ink increases with increases in a difference between the appropriate humidity Y0 and the humidity Y1 after the humidification and in the elapsed time from the start of the humidification. At the start of the humidification, only the ink near the ejection openings 14*a* becomes the low density ink, but as the time passes, the ink in the ejection openings 14*a* gradually changes to the low density ink, whereby a volume of the low density ink increases. Thus, the maintenance controlling section 64 calculates an amount of the low density ink on the basis of the difference between the appropriate humidity Y0 and the humidity Y1 after the humidification and the elapsed time from the start of the humidification to determine the obtained ink amount as the ink ejection amount for the flushing. The humidity Y1 after the humidification is an average humidity of the ejection spaces S1 and determined on the basis of a result of detections of humidity sensors (humidity detecting devices) 45 attached near the respective ejection spaces S1. It is noted that the humidity sensors 45 may not be provided, and in this case, the maintenance controlling section 64 may determine the ink ejection amount for the flushing by referring to a pre-stored table indicating a relationship between the difference between the appropriate humidity Y0 and the humidity Y1 after the humidification and the elapsed time from the start of the humidification.

Figure 10:
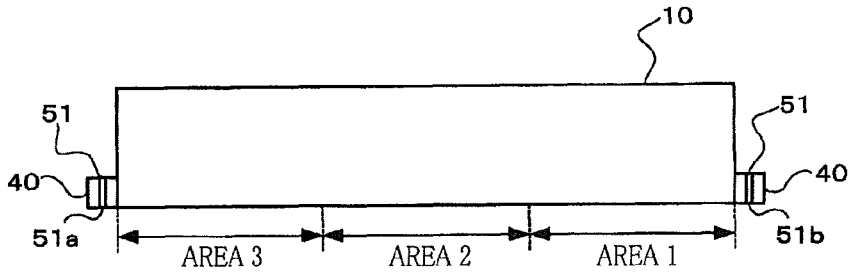
FIG. 10 is a view for explaining a function of a maintenance controlling section shown in FIG. 8.

Since each opening 51*b* through which the humid air is supplied is formed near one end portion of the corresponding ejection space S1 in the main scanning direction, a humidity distribution is formed in which the nearer to the opening 51*b* in the ejection space S1, the higher the humidity is. The maintenance controlling section 64 corrects the determined ink ejection amount for the flushing so as to correspond to the humidity distribution in the ejection space S1. Specifically, as shown in FIG. 10, the maintenance controlling section 64 divides the ejection face 10*a* into three areas 1-3 arranged side by side in the main scanning direction and each having a plurality of the ejection openings 14*a*. The maintenance controlling section 64 then corrects the ink ejection amount determined in the range in which the ink density is less than X0, such that the shorter a distance from the opening 51*b*, the larger the ink ejection amount for the flushing from the ejection openings 14*a* in the areas 1-3 in the capped state.

A viscosity of the ink in the ejection openings 14*a* increases due to drying with the longer elapsed time from the last ejection of the ink. Where the ink in the ejection openings 14*a* has a relatively high viscosity, the volume of the low density ink is small. Thus, the maintenance controlling section 64 refers to the ejection-history storage section 63 to further correct the ink ejection amount for the flushing such that the ink ejection amount from each of the ejection openings 14*a* decrease with the longer elapsed time.

In addition, also in a period from the change of the ejection space S1 from the capped state to the uncapped state for the recording, to the ejection of the ink, the volume of the low density ink in the ejection openings 14*a* decreases due to the drying. Thus, the maintenance controlling section 64 calculates a length of time of the period for each ejection opening 14*a* and corrects the ink ejection amount for the flushing such that the ink ejection amount decreases with the longer calculated length of time.

The maintenance controlling section 64 then controls the head 10 via the head controlling section 62 such that the corrected ink ejection amount of the ink is ejected in the flushing only from ejection openings 14*a* in each of which the corrected ink ejection amount is larger than a threshold value, among the ejection openings 14*a* through which the ink is to be ejected in the next recording. In this control, the maintenance controlling section 64 controls the head 10 via the head controlling section 62 such that non-ejection flushing is performed from ejection openings 14*a* in each of which the corrected ink ejection amount is less than the threshold value among the ejection openings 14*a* through which the ink is to be ejected in the next recording. The non-ejection flushing is an operation in which a meniscus of the ink formed in each ejection opening 14*a* is vibrated without the ejection of the ink. The ink ejected from the ejection openings 14*a* in the flushing is attached or landed on the support face 8*a*. The ink landed on the support face 8*a* is cleaned by a cleaning mechanism, not shown.

When the flushing is finished, the maintenance controlling section 64 rotates the gears 43 to move the movable member 42 upward, thereby moving the projecting portion 41*a* from the contact position to the distant position. As a result, the capping state of the caps 40 is changed from the capped state to the uncapped state, thereby establishing a recordable state, and the humidifying maintenance is completed. As thus described, in the present embodiment, the flushing is performed in the capped state in order to prevent the ink droplets from spreading or being splashed, but the flushing may be performed in the uncapped state. When the state of the printer 1 is changed to the standby state or the sleep state after the completion of the recording, the maintenance controlling section 64 rotates the gears 43 to move the movable member 42 downward, thereby moving the projecting portion 41*a* from the distant position to the contact position. As a result, the capping state is changed to the capped state.

Figure 11:
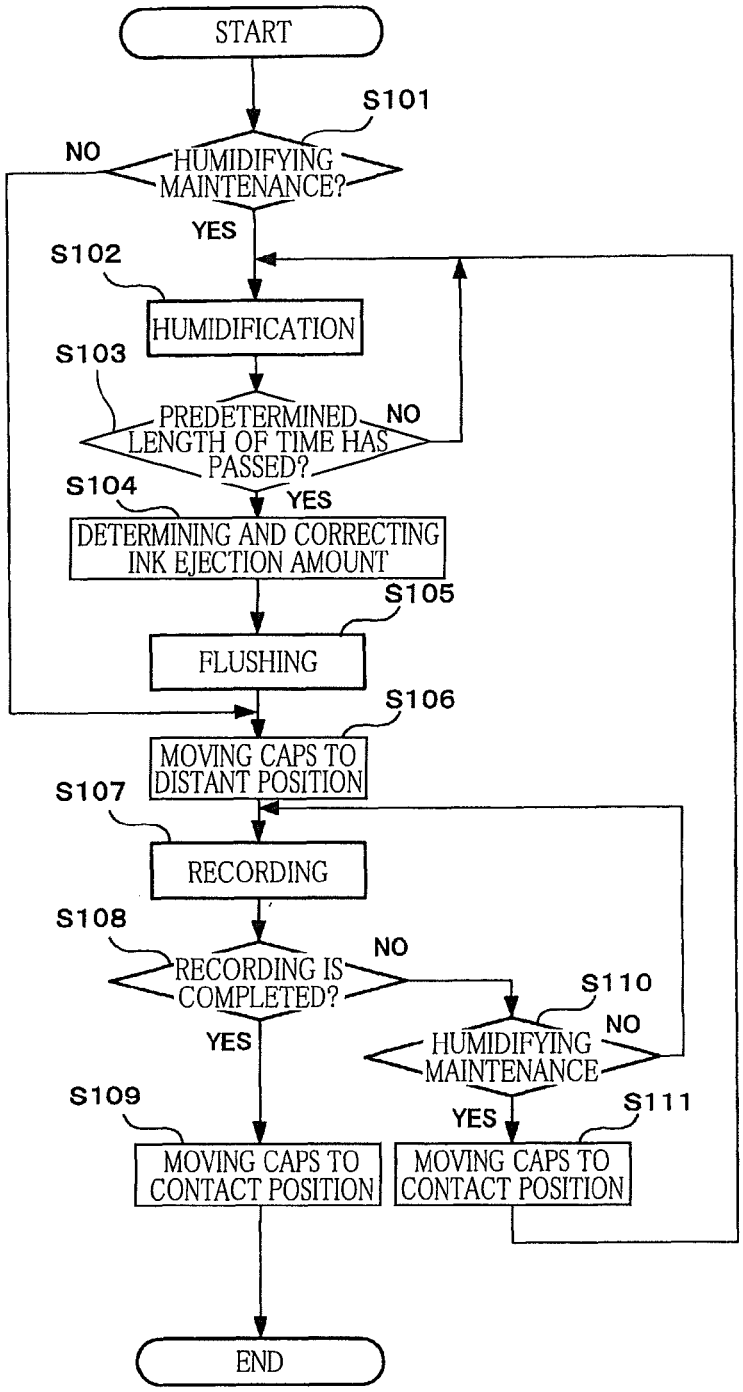
FIG. 11 is a flow-chart showing a recording operation of the printer in FIG. 1.

There will be next explained the recording operation of the printer 1 with reference to FIG. 11. As shown in FIG. 11, in S101, when the recording is started in the standby state (in the capped state), the maintenance controlling section 64 judges whether the humidifying maintenance is to be performed or not on the basis of whether the predetermined length of time has passed or not from the last recording. Where the maintenance controlling section 64 has judged that the humidifying maintenance is not to be performed (S101: NO), the maintenance controlling section 64 in S106 moves the projecting portion 41*a* from the contact position to the distant position to change the capping state from the capped state to the uncapped state (that is, the cap 40 is moved away from the support face 8*a*).

On the other hand, where the maintenance controlling section 64 has judged that the humidifying maintenance is to be performed (S101: YES), the maintenance controlling section 64 in S102 drives the pump 53 to suck the air in each ejection space S1 from the opening 51*a* of the corresponding joint 51 and supply the humidified air from the opening 51*b* into the ejection space S1. As a result, the ejection spaces S1 are humidified. Then in S103, the maintenance controlling section 64 judges whether or not the predetermined length of time has passed from a point in time when the humidity in the ejection space S1 becomes Y1 that is higher than the appropriate humidity Y0 and the humidification is started. Where the maintenance controlling section 64 has judged that the predetermined length of time has not passed (S103: NO), the maintenance controlling section 64 continues to drive the pump 53 in S102 until the predetermined length of time passes.

Where the maintenance controlling section 64 has judged that the predetermined length of time has passed (S103: YES), the maintenance controlling section 64 in S104 determines the ink ejection amount for the flushing on the basis of the difference between the appropriate humidity Y0 and the humidity Y1 after the humidification and the elapsed time from the start of the humidification (the length of time for which the humid air has been supplied to the ejection space S1, i.e., the predetermined length of time). It is noted that this predetermined length of time is set such that the humidity in the ejection space 51 is higher than the appropriate humidity Y0 when the humid air is supplied into the ejection space S1 from the tank 54. The maintenance controlling section 64 corrects the ink ejection amount determined in the range in which the ink density in each ejection opening 14*a* is less than X0, such that the shorter the distance from the opening 51*b*, the larger the ink ejection amount from each ejection opening 14*a* in the areas 1-3 in the capped state. Further, the maintenance controlling section 64 corrects the ink ejection amount for the flushing such that the ink ejection amount from the ejection opening 14*a* decreases with the longer elapsed time from the last ejection of the ink by referring to the ejection-history storage section 63. In addition, for each ejection opening 14*a*, the maintenance controlling section 64 calculates the length of time from the change of the ejection space S1 from the capped state to the uncapped state for the recording, to the ejection of the ink, and corrects the ink ejection amount for the flushing such that the ink ejection amount decreases with the longer obtained length of time.

Then in S105, the maintenance controlling section 64 controls the head 10 via the head controlling section 62 such that the corrected ink ejection amount of the ink is ejected in the flushing only from the ejection openings 14*a* in each of which the corrected ink ejection amount is larger than the threshold value, among the ejection openings 14*a* through which the ink is to be ejected in the next recording. In this control, the maintenance controlling section 64 controls the head 10 via the head controlling section 62 such that the non-ejection flushing is performed from the ejection openings 14*a* in each of which the corrected ink ejection amount is less than the threshold value among the ejection openings 14*a* through which the ink is to be ejected in the next recording. That is, the maintenance controlling section 64 controls the head 10 via the head controlling section 62 such that the meniscuses formed in the ejection openings 14*a* in each of which the corrected ink ejection amount is less than the threshold value are vibrated without the ejection of the ink.

Then in S106, when the flushing is finished, the maintenance controlling section 64 moves the projecting portion 41*a* from the contact position to the distant position to change the capping state from the capped state to the uncapped state. As a result, the humidifying maintenance is completed. Then in S107, the recording is performed on the sheet P. Where the recording on all the sheets P is completed (S108: YES), the maintenance controlling section 64 in S109 moves the projecting portion 41*a* from the distant position to the contact position to change the capping state from the uncapped state to the capped state (that is, the cap 40 is brought into contact with the support face 8*a*). When the change to the capped state is completed, the state of the printer 1 is changed to the standby state, and the processing indicated by the flow-chart in FIG. 11 is completed.

Where the recording on all the sheets P is not completed (S108: NO), the maintenance controlling section 64 in S110 judges whether the humidifying maintenance is to be performed or not on the basis of whether or not there is any ejection opening 14*a* in which the predetermined length of time has passed from the change of the ejection space S1 to the uncapped state without the ejection of the ink. Where the maintenance controlling section 64 has judged that the humidifying maintenance is not to be performed (S110: NO), the recording is performed on the next sheet P in S107. On the other hand, where the maintenance controlling section 64 has judged that the humidifying maintenance is to be performed (S110: YES), the maintenance controlling section 64 in S111 moves the projecting portion 41*a* from the distant position to the contact position to change the capping state from the uncapped state to the capped state and performs the above-described humidifying maintenance (S102 and the subsequent steps). These processings are repeated until all the recording operations are completed.

As described above, in the printer as the present embodiment, the ink in the ejection openings 14*a* is excessively humidified in the humidifying maintenance by supplying the humid air into the ejection spaces 51 such that the density of the ink in the ejection openings 14*a* becomes X1 that is less than the appropriate density X0. Then, the predetermined amount of the ink is ejected in the flushing before the recording to discharge the low density ink excessively humidified in the ejection openings 14*a*. As a result, it is possible to restrain the thickening of the ink in the ejection openings 14*a* without fine adjustment of a supply amount of the humid air. Thus, the ink having an appropriate density can be ejected in the recording.

Further, the maintenance controlling section 64 determines the ink ejection amount for the flushing such that the ink ejection amount increases with the increase in at least one of the difference between the appropriate humidity Y0 and the humidity Y1 after the humidification and the elapsed time from the start of the humidification. This makes it possible to reduce an amount of the ink needlessly ejected in the flushing.

Further, the maintenance controlling section 64 corrects the determined ink ejection amount for the flushing, such that the shorter the distance from the opening 51*b*, the larger the ink ejection amount from the ejection opening 14*a* in the areas 1-3 in the capped state. As a result, the low density ink in the ejection openings 14*a* can be efficiently ejected in the flushing, making it possible to further reduce the amount of the ink needlessly ejected in the flushing.

Further, the maintenance controlling section 64 corrects the ink ejection amount for the flushing such that the ink ejection amount from each ejection opening 14*a* decreases with the longer elapsed time from the last ejection of the ink by referring to the ejection-history storage section 63. In addition, for each ejection opening 14*a*, the maintenance controlling section 64 calculates the length of time from the change of the ejection space S1 from the capped state to the uncapped state for the recording, to the ejection of the ink, and corrects the ink ejection amount for the flushing such that the ink ejection amount decreases with the longer calculated length of time. As a result, the ejection amount of the low density ink is accurately determined, making it possible to reduce the amount of the ink needlessly ejected in the flushing while restraining the thickening of the ink in the ejection openings 14*a*.

Further, the maintenance controlling section 64 performs the flushing in the humidifying maintenance such that the ink is ejected only from the ejection openings 14*a* through which the ink is to be ejected in the next recording. Since the low density ink is not ejected from the ejection openings 14*a* through which the ink is not to be ejected in the recording, it is possible to reduce the amount of the ink needlessly ejected in the flushing while restraining the thickening of the ink in the ejection openings 14*a*.

Further, in the humidifying maintenance, the maintenance controlling section 64 controls the head 10 such that the non-ejection flushing is performed from the ejection openings 14*a* in each of which the corrected ink ejection amount is less than the threshold value among the ejection openings 14*a* through which the ink is to be ejected in the next recording. Thus, it is possible to reduce the amount of the ink needlessly ejected in the flushing while restraining the thickening of the ink in the ejection openings 14*a*.

Further, in the humidifying maintenance, the air sucked through the opening 51*a* is moved to the pump 53 through the hollow space 51*z* of the joint 51 and the tube 55 and then to the tank 54 through the tube 56. The air is then moved through the tube 57 and supplied from the opening 51*b* into the ejection space S1. Since this circulation allows reuse of the humid air, the humid air can be speedily supplied. Further, the humid air can be supplied in a state in which the ejection spaces S1 are sealed.

Further, the distal end 41*a*1 is selectively positioned at the contact position at which the distal end 41*a*1 is held in contact with the support face 8*a* of the conveyance belt 8 and at the distant position at which the distal end 41*a*1 is distant from the support face 8*a* of the conveyance belt 8. Thus, the ejection spaces S1 can be reliably sealed by a simple construction. Further, it is possible to speedily change the capped state and the uncapped state to each other.

While the embodiment of the present invention has been described above, it is to be understood that the invention is not limited to the details of the illustrated embodiment, but may be embodied with various changes and modifications, which may occur to those skilled in the art, without departing from the spirit and scope of the invention.

The maintenance controlling section 64 is configured to determine the ink ejection amount (for the flushing) corresponding to the volume of the low density ink for each ejection opening 14*a* such that the ink ejection amount increases with the increase in at least one of the difference between the appropriate humidity Y0 and the humidity Y1 after the humidification and the elapsed time from the start of the humidification, but the ink ejection amount for the flushing may be determined in advance. Further, the maintenance controlling section 64 may be configured to control the ejection independently of the elapsed time from the start of the humidification such that the larger the difference between the appropriate humidity Y0 and the humidity Y1 after the humidification, the larger amount of the ink ejected in the flushing, and may be configured to control the ejection independently of the humidity in the ejection space S1 after the humidification such that the longer the elapsed time from the start of the humidification, the larger the ejection amount in the flushing becomes.

Further, each of the areas 1-3 formed on the ejection face 10*a* has the plurality of the ejection openings 14*a*, but at least a part of an area on the ejection face 10*a* may have only a single ejection opening 14*a*.

Further, the maintenance controlling section 64 is configured to correct the ink ejection amount for the flushing determined for each of the areas 1-3, but such a correction may not be performed. Further, the maintenance controlling section 64 may be configured to control the ejection such that, the shorter the distance between the ejection opening 14*a* and the opening 51*b*, the larger amount of the ink is discharged in the flushing regardless of whether each ejection opening 14*a* is formed in any of the areas.

Further, for each of the ejection openings 14*a*, the maintenance controlling section 64 is configured to correct the ink ejection amount for the flushing such that the ink ejection amount decreases with the longer elapsed time from the last ejection, but such a correction may not be performed.

Further, for each of the ejection openings 14*a*, the maintenance controlling section 64 corrects the ink ejection amount for the flushing such that the ink ejection amount from the ejection opening 14*a* decreases with the longer elapsed time from the change of the ejection space S1 from the capped state to the uncapped state for the recording, to the ejection of the ink, but such a correction may not be performed.

Further, in the humidifying maintenance, the maintenance controlling section 64 ejects the ink in the flushing only from the ejection openings 14*a* in each of which the corrected ink ejection amount is larger than the threshold value, among the ejection openings 14*a* through which the ink is to be ejected in the next recording, but the ink may be ejected in the flushing from the ejection openings 14*a* in each of which the corrected ink ejection amount is less than the threshold value. Further, the ink may be ejected in the flushing from ejection openings 14*a* in each of which the ink is not ejected in the next recording.

Further, the maintenance controlling section 64 performs the non-ejection flushing in the humidifying maintenance for the ejection openings 14*a* in each of which the corrected ink ejection amount is less than the threshold value among the ejection openings 14*a* through which the ink is to be ejected in the next recording, but the non-ejection flushing may be performed from the ejection openings 14*a* in each of which the ink is not to be ejected in the next recording. Further, the non-ejection flushing may not be performed from at least a part of the ejection openings 14*a*.

Further, in the humidifying maintenance, the air is circulated such that the air sucked through the openings 51*a* is supplied to the ejection spaces S1 through the openings 51*b*, but the humid air only needs to be supplied through the openings 51*b*. For example, the humid air may not be circulated.

Further, in the above-described embodiment, the gears 43 and so on are used as a moving mechanism for moving the projecting portion 41*a*, but various mechanism and components may be used such as a cam mechanism using a solenoid and a link.

Further, the projecting portion 41*a* is not limited to be movable as in the above-described embodiment. For example, the printer 1 may be configured such that the projecting portions are fixed to the head holder so as not to be movable, and the position of the distal ends of the respective projecting portions relative to the respective ejection faces is constant. In this case, the position of the distal ends of the respective projecting portions relative to the respective ejection faces can be changed by raising and lowering the head holder or the support face of the medium support portion, whereby the projecting portions can be selectively positioned at the contact position and the distant position.

Further, each recessed portion 3*x* formed in the head or the face of the head holder is not limited to have a circular shape along the perimeter of the ejection face 10*a* in plan view and may be formed only in an opening-formed portion of the one end and/or the other end of the circulation channel.

Figure 12:
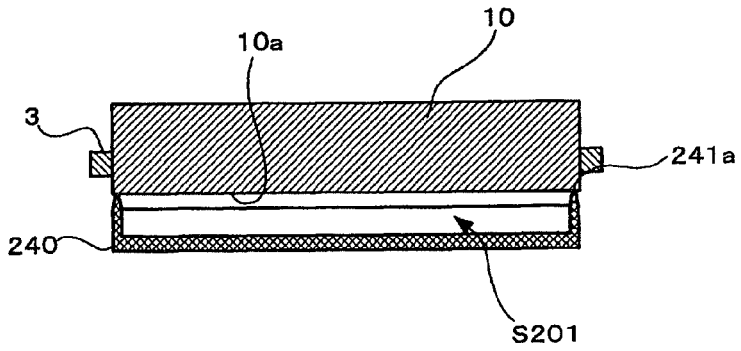
FIG. 12 is a view for explaining a first modification of the embodiment.

Further, as shown in FIG. 12, a cap (cap member) 240 may be formed independently of the head 10. In this case, the cap 240 is disposed at a position facing the ejection face 10*a* by a cap moving mechanism, not shown. The cap 240 can be selectively positioned at a contact position at which an end portion 241*a* of the cap 240 is held in contact with the ejection face 10*a* and a distant position at which the end portion 241*a* is distant from the ejection face 10*a* by raising or lowering at least one of the head 10 and the cap 240. When the cap 240 is located at the contact position, an ejection space S201 is sealed with the cap 240 (a capped state). When the cap 240 is located at the distant position, the ejection space 5201 is not sealed (an uncapped state).

Figure 13:
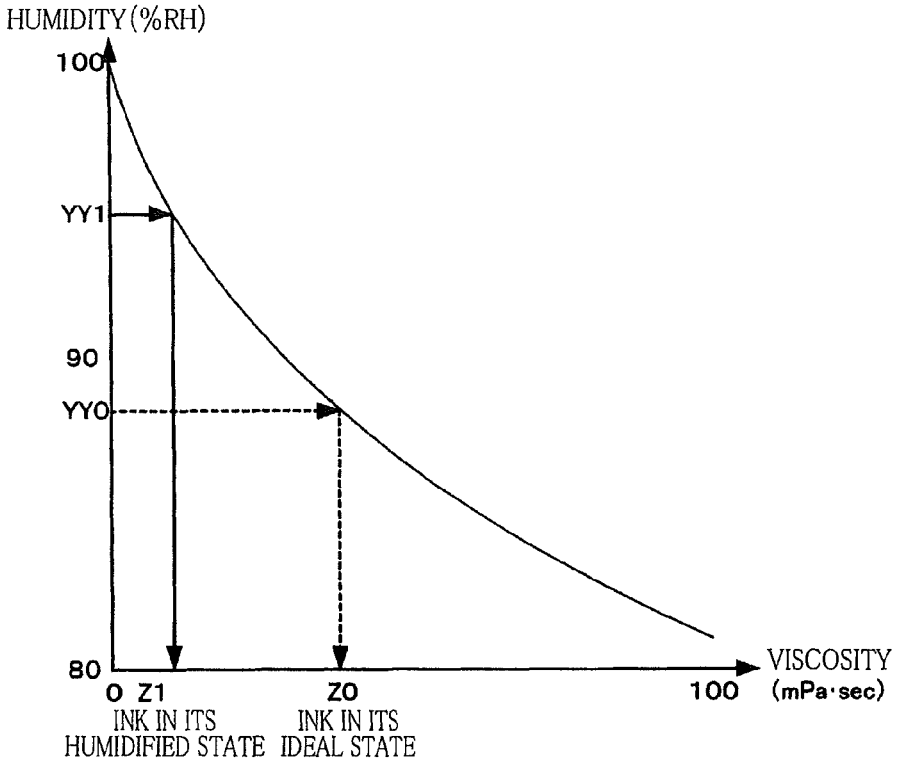
FIG. 13 is a view for explaining a second modification of the embodiment.

Further, in the above-described embodiment, the printer 1 is configured such that, after the ink in the ejection openings 14*a* is humidified so as to be partly changed to the low density ink, the ink ejection amount for the flushing is determined such that the low density ink is discharged, but the printer 1 may be configured such that, after the ink in the ejection openings 14*a* is humidified so as to be partly changed to low viscosity ink, the ink ejection amount for the flushing is determined such that the low viscosity ink is discharged. That is, as shown in FIG. 13, the viscosity of the ink in each ejection opening 14*a* lowers as the humidity in the ejection space S1 rises. It is noted that FIG. 13 indicates a relationship between the humidity and the ink viscosity in equilibrium. The maintenance controlling section 64 preferably drives the pump 53 such that the viscosity of the ink in the ejection openings 14*a* becomes Z1 that is less than an appropriate viscosity Z0 in which the ink is stably ejected from the ejection openings 14*a* (the ink is in its ideal state), in other words, such that the humidity in the ejection space S1 becomes YY1 (e.g., 95%) that is higher than an appropriate humidity (predetermined humidity) YY0 (e.g., 88%) corresponding to the ink viscosity Z0. In this case, the maintenance controlling section determines the ink ejection amount such that only the low viscosity ink is ejected from the ejection openings 14*a*, for example.

Further, a shape and a position of each of the openings of the one end and the other end of the circulation channel are not particularly limited as long as the opening is formed in the head or the head holder and opened in the ejection space. For example, the printer 1 may be configured such that one of the openings is formed in the head, and the other of the openings is formed in the head holder. The opening may be formed in the projecting portion. Further, the printer 1 may be configured such that each recessed portion 3*x* is not formed in the head or the face of the head holder, and the opening(s) of the one end and/or the other end of the circulation channel is formed at the same height level as that of the ejection face 10*a*. The openings may be formed at positions interposing (on opposite sides of) the ejection face 10*a* in the sub-scanning direction in plan view (in the case where the openings are formed in the head, the openings may be formed at positions interposing an ejection-opening group in the sub-scanning direction in plan view). Alternatively, the openings may be formed at positions not interposing the ejection face 10*a* (or the ejection-opening group) in plan view. That is, the openings may be formed on the same side of the ejection face 10*a* (or the ejection-opening group) in one direction.

Further, the printer 1 may be configured such that four pumps each as the pump 53 and four tanks each as the tank 54 are provided for the respective heads 10, and four tubes each as the tube 55 and four tubes each as the tube 57 are provided for the respective heads 10.

Further, the pump 53 and the tank 54 are used as humidifying devices in the above-described embodiment, but other components or mechanism may be used as long as the air in the circulation channel can be humidified. For example, the printer 1 may be configured such that the humidification is performed only by the tank 54 without providing the pump 53. Further, the humidification may be performed by further using a heating means such as a heater, by using an ultrasound humidifying means, or by disposing a wet porous material such as a wet sponge or a wet cloth in the circulation channel.

Further, in the above-described embodiment, the maintenance controlling section 64 is configured to discharge the low density ink by the flushing, but the low density ink may be discharged by the purging. That is, a preliminary ejection includes the purging in addition to the flushing.

In the above-described embodiment, the printer 1 includes the water-temperature sensor 46 and the heater 58, but these components may be omitted.

Further, the flushing in S105 in FIG. 11 may be performed onto an additionally provided ink receiving member after the movement of the projecting portion 41*a* to the distant position (in S106) and before the recording (in S107).

The present invention is applicable to any of a line printer and a serial printer. Further, the application of the present invention is not limited to the printer, and the present invention is also applicable to devices such as a facsimile machine and a copying machine. Further, the present invention is also applicable to a device configured to eject liquid other than the ink.

What is claimed is:

1. A liquid ejection apparatus, comprising:

a liquid-ejection head having a plurality of ejection openings and configured to eject liquid through the ejection openings to record an image on a recording medium;

a sealing mechanism configured to selectively establish (i) a sealed state in which an ejection space in which the ejection openings are open is sealed from an outside and (ii) an unsealed state in which the ejection space is not sealed from the outside;

a humid-air supply mechanism configured to supply a humid air into the ejection space; and a controller configured to control the sealing mechanism, the humid-air supply mechanism, and the liquid-ejection head, wherein, during the sealed state of the ejection space established by the sealing mechanism, the controller controls the humid-air supply mechanism to supply the humid air into the ejection space such that one of a density and a viscosity of the liquid to be ejected from the ejection openings becomes less than a predetermined appropriate value, and then controls the liquid-ejection head such that the liquid having an amount equal to or larger than a set amount is preliminarily ejected through the ejection openings as a preliminary ejection prior to the ejection of the liquid onto the recording medium for recording the image on the recording medium.

2. The liquid ejection apparatus according to claim 1, wherein the controller is configured to control the liquid-ejection head to perform the preliminary ejection when the sealed state is continued, after the controller has controlled the humid-air supply mechanism to supply the humid air into the ejection space.

3. The liquid ejection apparatus according to claim 1, wherein the controller is configured to set the set amount such that the larger a difference between (i) an appropriate humidity that is a humidity when one of the density and the viscosity of the liquid in the ejection openings is the appropriate value and (ii) a humidity in the ejection space that is a humidity when the humid air is supplied and that is higher than the appropriate humidity, the larger the set amount becomes.

4. The liquid ejection apparatus according to claim 1, wherein the controller is configured to control the sealing mechanism to keep the sealed state of the ejection space at least until the humid air is supplied into the ejection space and then the preliminary ejection is performed, and wherein the controller is configured to set the set amount such that the longer an elapsed time elapsed from a start of the supply of the humid air into the ejection space to the preliminary ejection, the larger the set amount becomes.

5. The liquid ejection apparatus according to claim 1, wherein one of the liquid-ejection head and the sealing mechanism has an inlet opening through which the humid air supplied by the humid-air supply mechanism flows into the ejection space, and wherein, where a distance between one ejection opening of the plurality of ejection openings and the inlet opening is shorter than a distance between another ejection opening of the plurality of ejection openings and the inlet opening, the controller increases the set amount set for the one ejection opening to an amount that is larger than the set amount set for said another ejection opening.

6. The liquid ejection apparatus according to claim 5, wherein the liquid-ejection head has an ejection face in which the plurality of ejection openings are open, wherein the ejection face has a plurality of areas including an area having the one ejection opening and an area having said another ejection opening, wherein where a distance between the area having the one ejection opening and the inlet opening is shorter than a distance between the area having said another ejection opening and the inlet opening, the controller increases the set amount set for ejection openings formed in the area having the one ejection opening to an amount that is larger than the set amount set for ejection openings formed in the area having said another ejection opening.

7. The liquid ejection apparatus according to claim 1, wherein the controller is configured to control the liquid-ejection head to preliminarily eject the liquid only from the ejection openings from which the liquid is to be ejected onto the recording medium in image recording that follows the preliminary ejection.

8. The liquid ejection apparatus according to claim 1, wherein the controller includes an elapsed-time storing section configured to store an elapsed time elapsed from the last ejection of the liquid for each of the plurality of ejection openings, and wherein the controller is configured to set the set amount for each of the ejection openings such that the longer the elapsed time, the smaller the set amount becomes.

9. The liquid ejection apparatus according to claim 1, wherein the controller is configured to calculate, for each of the plurality of ejection openings, a length of time from the preliminary ejection to the ejection of the liquid onto the recording medium for recording the image, and wherein the controller is configured to set the set amount for each of the ejection openings such that the longer the calculated time, the smaller the set amount becomes.

10. The liquid ejection apparatus according to claim 1, wherein, before the ejection space is changed from the sealed state to the unsealed state and the image recording on the recording medium is started, the controller controls the liquid-ejection head to vibrate meniscuses formed in the respective ejection openings in each of which the set amount is equal to or less than a threshold value, without preliminarily ejecting the set amount of the liquid from the ejection openings.

11. The liquid ejection apparatus according to claim 1, wherein one of the liquid-ejection head and the sealing mechanism has:

an inlet opening through which the humid air supplied by the humid-air supply mechanism flows into the ejection space; and an outlet opening through which the air in the ejection space is discharged, and wherein the air discharged from the outlet opening is supplied to the humid-air supply mechanism.

12. The liquid ejection apparatus according to claim 1, wherein the sealing mechanism includes a cap member having a recessed portion formed therein, and wherein the sealing mechanism is configured to establish (a) the sealed state by covering the plurality of ejection openings with the recessed portion such that the recessed portion seals the ejection space and (b) the unsealed state by moving the cap member to a position at which the plurality of ejection openings are not covered with the recessed portion.

13. The liquid ejection apparatus according to claim 1, wherein the sealing mechanism includes:

a head holder holding the liquid-ejection head;

an opposed member having an opposed face opposed to the plurality of ejection openings, with the ejection space interposed therebetween; and a projecting portion provided on the head holder and configured to seal the ejection space from the outside in a state in which a distal end of the projecting portion is held in contact with the opposed face.

14. A liquid ejection apparatus, comprising:

a liquid-ejection head having a plurality of ejection openings and configured to eject liquid through the ejection openings to record an image on a recording medium;

a sealing mechanism configured to selectively establish (i) a sealed state in which an ejection space opposed to the ejection openings is sealed from an outside and (ii) an unsealed state in which the ejection space is not sealed from the outside;

a humid-air supply mechanism configured to supply a humid air into the ejection space;

a humidity detecting device configured to detect a humidity in the ejection space; and a controller configured to control the sealing mechanism, the humid-air supply mechanism, and the liquid-ejection head, wherein, during the sealed state of the ejection space established by the sealing mechanism, the controller controls the humid-air supply mechanism to supply the humid air into the ejection space such that the humidity in the ejection space becomes higher than a predetermined appropriate value, and then controls the liquid-ejection head such that the liquid having an amount equal to or larger than a set amount is preliminarily ejected through the ejection openings as a preliminary ejection prior to the ejection of the liquid onto the recording medium for recording the image on the recording medium, and wherein the controller is configured to set the set amount on the basis of the predetermined appropriate value and the humidity detected by the humidity detecting device.

15. A nonvolatile storage medium storing a program to be executed by a liquid ejection apparatus, the liquid ejection apparatus comprising:

a liquid-ejection head having a plurality of ejection openings and configured to eject liquid through the ejection openings to record an image on a recording medium;

a sealing mechanism configured to selectively establish (i) a sealed state in which an ejection space in which the ejection openings are open is sealed from an outside and (ii) an unsealed state in which the ejection space is not sealed from the outside; and a humid-air supply mechanism configured to supply a humid air into the ejection space, the program comprising:

controlling, during the sealed state of the ejection space established by the sealing mechanism, the humid-air supply mechanism to supply the humid air into the ejection space such that one of a density and a viscosity of the liquid to be ejected from the ejection openings becomes less than a predetermined appropriate value; and then controlling the liquid-ejection head such that the liquid having an amount equal to or larger than a set amount is preliminarily ejected through the ejection openings as a preliminary ejection prior to the ejection of the liquid onto the recording medium for recording the image on the recording medium.

* * * * *